US005205505A

United States Patent [19]

Focke et al.

[11] Patent Number: 5,205,505

[45] Date of Patent: Apr. 27, 1993

[54] DEVICE FOR SUPPLYING PACKAGING MACHINES WITH PACKAGING MATERIAL

[75] Inventors: Heinz Focke; Wolfgang Oertel, both of Verden, Fed. Rep. of Germany

[73] Assignee: Focke & Co., Verden, Fed. Rep. of Germany

[21] Appl. No.: 722,827

[22] Filed: Jun. 28, 1991

[30] Foreign Application Priority Data

Jul. 31, 1990 [DE] Fed. Rep. of Germany ..... 4024284

[51] Int. Cl.[5] ..... B65H 19/12

[52] U.S. Cl. ..... 242/58.6; 242/79

[58] Field of Search ..... 242/58.6, 58, 58.1, 242/58.2, 58.3, 58.4, 79, 35.5 A

[56] References Cited

U.S. PATENT DOCUMENTS

| | | | |
|---|---|---|---|
| 3,695,539 | 10/1972 | Lindstaedt | 242/58.6 |
| 4,055,313 | 10/1977 | Yamaguchi et al. | 242/79 X |
| 4,589,811 | 5/1986 | Riccardo et al. | 242/58.6 X |
| 4,840,321 | 6/1989 | Focke et al. | 242/58.6 |
| 4,896,842 | 1/1990 | Focke et al. | 242/58.6 |
| 4,973,008 | 11/1990 | Focke et al. | 242/58.6 |
| 5,031,381 | 7/1991 | Focke | 242/58.6 X |

FOREIGN PATENT DOCUMENTS

| | | |
|---|---|---|
| 296356 | 5/1988 | European Pat. Off. . |
| 347586 | 5/1989 | European Pat. Off. . |
| 3631205 | 3/1988 | Fed. Rep. of Germany . |
| 3721091 | 1/1989 | Fed. Rep. of Germany . |
| 3812514 | 10/1989 | Fed. Rep. of Germany . |
| 3827917 | 12/1989 | Fed. Rep. of Germany . |

*Primary Examiner*—Stanley N. Gilreath
*Attorney, Agent, or Firm*—Sughrue, Mion, Zinn Macpeak & Seas

[57] ABSTRACT

For the production of cigarettes packages consisting of several components, e.g. soft packages of hinge-lid packages, tin foil and paper or cardboard are processed in packaging machine as various packaging materials. The packaging material is supplied in the form of bobbins (tin foil bobbins 13, paper bobbins 14). The packaging machine is equipped with two bobbin storages (23, 24) for the reception of tin foil bobbins (13) or paper bobbins (14). The bobbin storages (23, 24) are supplied with the various bobbins (13, 14) by a common supplier, i.e. a floor-mounted supplier (15). The various bobbins (13, 14) are removed from the bobbin storages (23, 24) by means of a transversal supplier (transport cog 51) and conveyed to a common downward-delivering bobbin supplier (5) which transports the bobbins to superpositioned bobbin-processing assemblies (42, 43) in which the packaging material is process, i.e. withdrawn from the bobbins.

6 Claims, 7 Drawing Sheets

DEVICE FOR SUPPLYING PACKAGING MACHINES WITH PACKAGING MATERIAL

BACKGROUND OF THE INVENTION

The invention relates to a device for the supply of Packaging machines with packaging materials, which are made available as rolled lengths of materials (bobbins), a packaging machine being allocated at least one bobbin storage from which the bobbins can be removed successively and fed to a working cog.

In the packaging industry the supply of packaging machines and other similar devices for processing rolled lengths of material is a special problem. Due to the high capacity of the packaging machines, the consumption of packaging material is considerable. The rolled bobbins consisting of tin foil, plastic foil and paper have a considerable weight due to their dimensions. This aggravates manual handling. Proper planning has the purpose of maintaining a sufficient supply of packaging material in the vicinity of the packaging machines and, furthermore, of guaranteeing the handling of the bobbins with as little as possible manual application.

It is common to store the bobbin on a rotating working cog for the withdrawal of the length of material. The length of the packaging material is withdrawn from the rotating bobbin and processed to the cut sizes for the single packages.

In a known device (EP-A-296 356corresponding to U.S. Pat. No. 4,896,842) two working cogs are arranged on a common slewable lug. One working cog is always in work position with the material being withdrawn, the other being supplied with a new bobbin in a charging station. The lug is 180° slewable in order to move the working cogs to and from the work position and the charging station. In this known proposal, the bobbins are taken successively from a bobbin storage and supplied to the working cog by a supply cog. Transfer takes place by an axial position of the working cog and the supply cog.

This known device does not lead to a maximum efficiency in the supply of the packaging stations of a packaging machine with rolled packaging material.

SUMMARY OF THE INVENTION

Therefore the purpose of the invention is to provide a device for the supply of packaging machines with rolled bobbins of packaging material, which device enables a highly efficient supply of packaging material without manual application to the processing station, in particular to the working cog.

The solution of this task is characterized according to the invention in that the bobbin storage is arranged above the working cog, in particular above the packaging machine, the bobbin being supplied to the working cog by way of a vertical supplier from the area of the bobbin storage.

By way of the vertical supplier in the region of the packaging machine in accordance with the invention, the bobbins can be supplied from an upper supply area or an upper storage to a processing station in the lower area of the packaging machine. Hence, storage and consumption of the packaging material meet the machine.

The invention is of particular advantage in the processing of different bobbins, i.e. with different packaging material like tin foil bobbins, paper bobbins and plastic foil bobbins. For this, several, in particular two, bobbin storages are adjacently arranged in the region of an upper level. One common vertical supplier for all bobbins or bobbin storages transports the bobbins requested after use-up to one of several consumption stations. Each of these consists of a working cog for the reception of a bobbin. The working stations are arranged one above the other, enabling the vertical supplier to reach them directly.

The bobbins are supplied to the vertical supplier by a supply cog which extracts the requested bobbin from the corresponding bobbin storage and supplies it to the vertical supplier by axial movement. For this purpose the supply cog is also movable in a transverse direction, i.e. by a pivoting lug between the bobbin storages.

In accordance with a further characteristic of the invention the bobbins are supplied by means of a floor-mounted supplier. It runs above the packaging machines at a distance along a carrying rail through the building along the packaging machines. Each bobbin storage is allocated a bobbin supplier for the reception of the bobbins from the floor-mounted supplier and for its transport to the deposit in the bobbin storage.

After the consumption of a bobbin in the area of the consumption station (working cog), the bobbins rest or the bobbin core can be removed manually from the working cog. In accordance with a further proposition of the invention the bobbin core can be removed automatically from the working cog. For this purpose an end limitation of the bobbin, i.e. a bobbin disc, can be axially moved taking along with it the bobbin core and stripping it from the working cog.

Further characteristics of the invention concern the formation of suppliers for the bobbins and the formation of the working cog with automatic stripping of the bobbin core.

An embodiment in accordance with the invention will now be described in greater detail with reference to the drawings:

DESCRIPTION OF A PREFERRED EMBODIMENT

Figure 1:
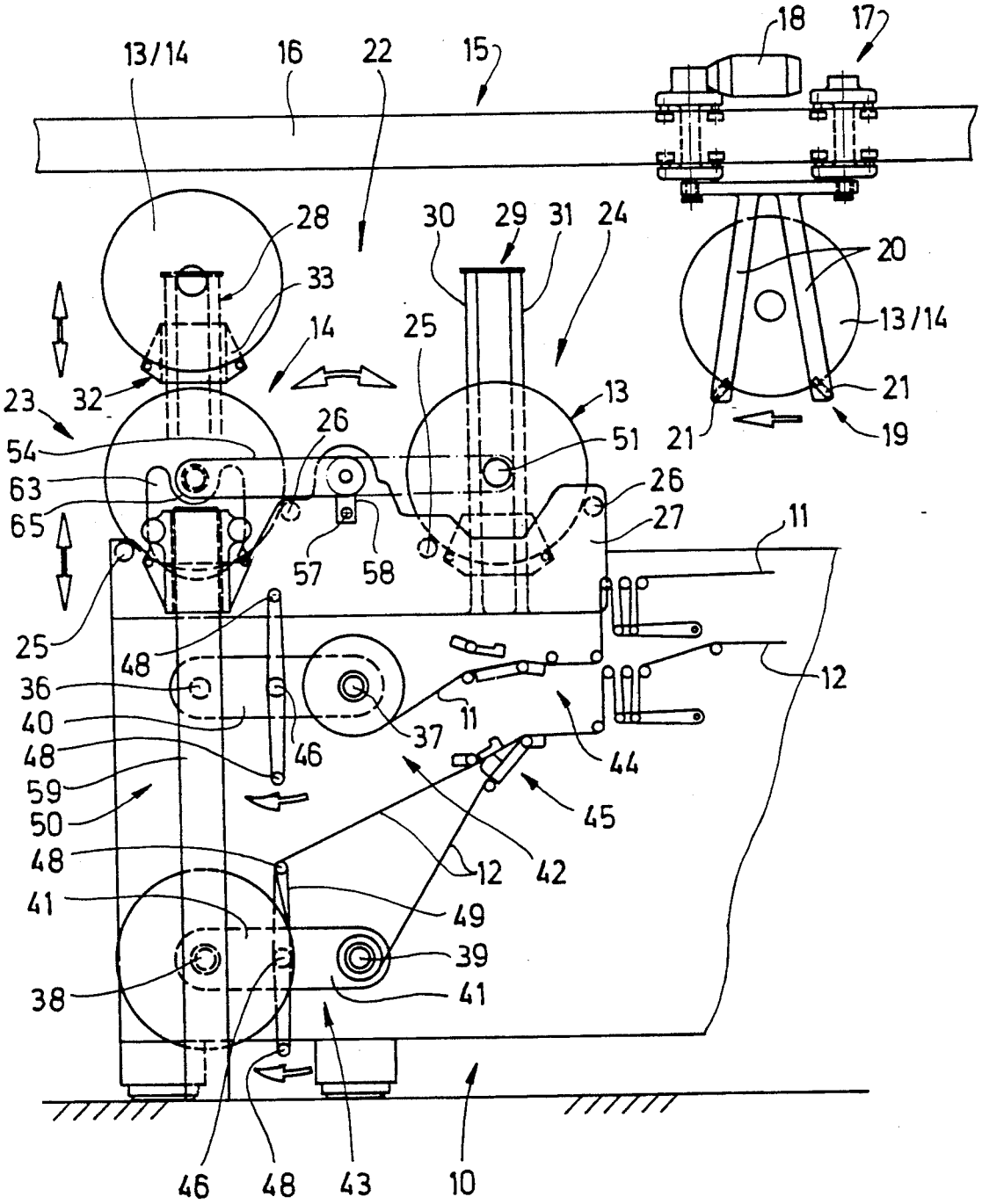
FIG. 1 shows a schematic sideview of a device for the supplying, storing and processing of different bobbins.

The present embodiment relates to the production of cigarette packages, e.g. of soft packages or hinge-lid packages. For this a packaging machine 10 of suited, conventional construction is applied. Because of the design of the packages to be produced, two different packaging materials are processed, available in the form of continuous lengths of material from which blanks are cut off for the production of packages. According to the present embodiment an upper length of material can consist of tin foil (tin foil path 11), a lower length of material can consist of paper (paper path 12). The packaging material is delivered in the rolled form of a bobbin and made available. The materials are drawn off the bobbins. Hence, in accordance with the present example tin foil bobbins 13 and paper bobbins 14 are present for processing.

In the present, preferred embodiment the bobbins 13 and 14 are supplied to the various consumption places (packaging machines 10) from a central loading station by a floor-mounted supplier 15. The floor-mounted supplier 15 consists of a carrying rail 16 circulating through the packaging installation, and is e.g. mounted on a corner of the building or on a higher placed supporting frame. Roller carriages 17 travel on bearings on the carrier rails 16. These are driven by a motor 18 and moved along the carrier rail 16. On the lower side of the roller carriage 17 and hence below the carrier rail 16, a bobbin carrier 19 is located with two diverging lugs 20 and transversely pointed, i.e. essentiallt horizontal, sleepers 21 located on the lower ends of the lugs 20. A bobbin 13, 14 is placed on the sleepers 21. Advantageously, the floor-mounted supplier 15 and especially the roller carriages 17 and/or the bobbin carrier 19 are formed in the manner as described and represented in EP-A-347 586 (corresponding to U.S. Pat. No. 5,007,522).

The bobbins 13, 14 are transferred in a transfer station 22 to a packaging machine 10 in the vicinity of the same. In the present embodiment two bobbin storages 23, 24 are arranged on the upper side of the packaging machine 10. The one bobbin storage 23—in the present case on the edge of the packaging machine 10—serves for the reception of a supply of paper bobbins 14. The adjacent bobbin storage 24 is allocated a supply of tin foil bobbins 13.

In the present case each bobbin storage 23, 24 consists essentially of two carrying rods 25, 26. These are driven in a rotating manner and slightly diverge into the transporting direction of the bobbins. Essentially, the bobbin storages 23, 24 are formed, as provided in EP-A-296 356 (corresponding to U.S. Pat. No. 4,896,842), however under the provision that the two carrying rods, 25, 26 are staggered to each other in height. The bobbins 13, 14 are placed with their outer surfaces on the carrying rods 25, 26. Their ends are pivoted in an upright machine cheek 27.

Each bobbin storage 23, 24 is allocated its own bobbin lift 28, 29. It consists of two vertical guide rods 30, 31 on which a bobbin receptacle 32 with a sleigh 33 and transversly protruding carrier cogs 34, 35 are run on bearings.

The bobbin receptacle 32 of the bobbin lift 28, 29 corresponds on the one hand with the bobbin carrier 19 and on the other hand with the allocated bobbin storage 23, 24. The carrier cogs 34, 35 serve for the storage of a bobbin 13, 14 on their outer surface. In the upper position the carrier cogs 34, 35 can in upward direction be moved around the sleepers 21 of the bobbin carrier 19, enabling the bobbin 13, 14 to be lifted off the sleepers 21 and to be accepted. The empty bobbin carrier 19 can now be moved on. The bobbin receptacle 32 is now moved downward together with the bobbin 13, 14 into the area of the bobbin storage 23 or 24. Here the carrier cogs 34, 35 are moved so far down that the respective bobbin 13, 14 can be accepted by the carrying rods 25, 26. In the region of the bobbin storage 23, 24 the bobbin is then moved in axial direction (in FIG. 3 left to right). This way the bobbin receptacle 32 is set free again and can be moved upwards for the reception of a subsequent bobbin.

The carrier cogs 34, 35 of the bobbin receptacle 32 are at a clearly smaller distance from each other than the carrying rods 25, 26 of the bobbin storage 23, 24, enabling the described relative movement for the transfer of the bobbins 13, 14.

Figure 3:
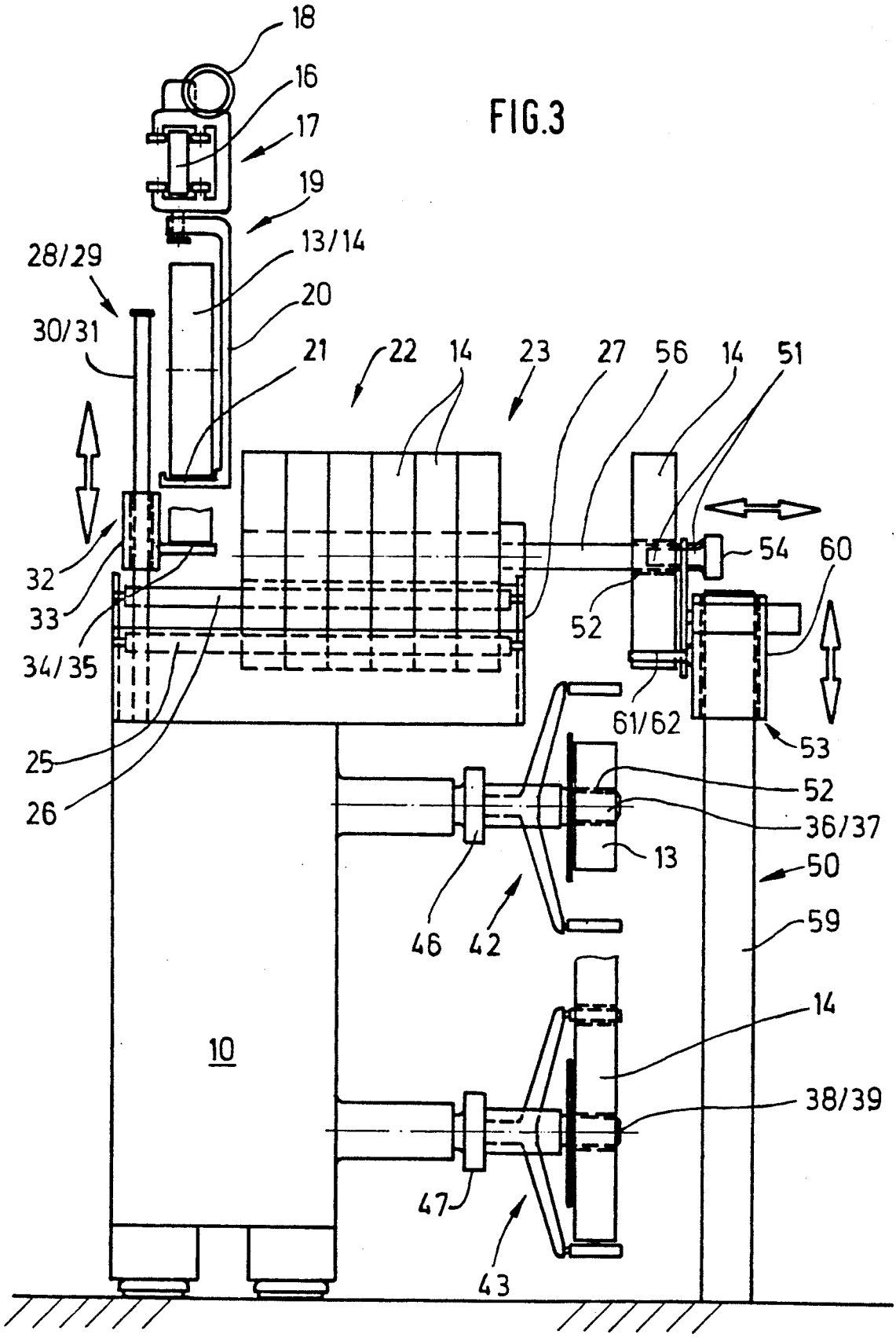
FIG. 3 shows a sideview of the device in accordance with FIG. 1.

The bobbin storages 23, 24 are arranged on top of the machine frame of the packaging machine 10 in a traverse manner, i.e. protruding over the machine frame (FIG. 3). This way a removal side of the bobbin storage 24 lies essentially above the processing aggregates (assemblies) for the bobbins 13, 14.

In the shown device two processing aggregates are arranged in superposition, for tin foil bobbins 13 and for paper bobbins 14. Each of the processing aggregates consists of two freely projecting working cogs 36, 37 and 38, 39. Two working cogs 36, 37 are arranged at the end of a swinging arm 40, 41. It serves as the transporting organ and carrier of the working cogs 36, 37; 38, 39 in order to move these from a receiving position (left in FIG. 1 and FIG. 2) to a working position (right in FIG. 1 and FIG. 2). In the working position each of the lengths of material, i.e. tin foil path 11 and paper path 12, are drawn off the corresponding bobbin 13, 14. One swinging arm 40, 41 together with working cogs 36, 37 or 38, 39 and further aggregates are referred to as bobbin aggregate 42, 43.

Each bobbin aggregate 42, 43 is allocated a material connector 44, 45. These are automatically or semiautomatically functioning installations in order to connect the ending length of material with the beginning of the new length of material. The material connectors can, e.g. be formed as in EP-A-179 243.

The swinging arms 40, 41 are pivoted around a central bearing 46, 47. With these swinging arms 40, 41 and the working cogs 36..39 attached thereto, deflection rollers 48 are movable which are attached to the holding arms 49 which are attached transversly to the swinging arms 40, 41 which are directed transversly to the swinging arms. The deflection rollers 48 serve as guides for the lengths of material.

The bobbin aggregates 42, 43 are superpositioned in the present case. A common bobbin transporter 50 serves for supplying the bobbin aggregates 42, 43 with bobbins 13, 14, by accepting the bobbins 13, 14 in an upper position and supplying them with a downward movement to one of the bobbin aggregates 42, 43.

The bobbin transporter 50 is determined for the (downward) transport of bobbins 13, 14 of both bobbin storages 23, 24. The bobbin transporter 50 is arranged centrally in the region or below the bobbin storage 23, however displaced in axial direction (FIG. 3).

From both bobbin storages 23, 24 bobbins 13, 14 are removed by the transfer transporter and transferred to the transporter 50. It is here a transport cog 51 which enters into the central opening 52 of the bobbins 13, 14, similar to the working cogs 36..39. The transport cog 51 can be moved in axial and cross-axial direction. It is inserted into the central opening 52 of a bobbin 13, 14 placed in front in the bobbin storage 23 or 24 and lifts it. The transport cog 51 is lifted with the bobbin 13, 14 freeing it from the bobbin storage 23, 24. Now the axial movement to the level of the bobbin transporter 50 or a carrying means 50 thereof takes place. If the bobbin is removed from the bobbin storage 23 in the immediate neighborhood to the bobbin transporter 50, no cross conveyance is needed. Here, the bobbin can be placed on the carrying means 53 immediately after execution of the represented transporting movement. If however a tin foil bobbin 13 is to be removed from the bobbin storage 24, a cross-axially directed transport to the carrying means 53 takes place after an upward movement and axial displacement of the bobbin.

In the present example the transport cog 51 is mounted on a transport arm 54. The latter runs as a one-armed lever on bearings centrally between the bobbin storages 23, 24. The transport arm 54 with the transport cog 51 on the free end is 180° slewable in order to receive a tin foil bobbin from the bobbin storage 24 and for its transfer to the carrying means 53.

The transport arm 54 is pivoted (slewable) in a bearing 55 and is axially movable. The axial movement of the tranport arm 54 or a shaft 56 thereof takes place by a suitable linear drive, e.g. by a rotating spindle 57 which is here arranged on bearings below the shaft 56 and connected to the transport arm 54 via a spindle nut 58.

In the present embodiment the upright bobbin transporter 50 consists of a firm squared column 59. Along it the carrying means 53 can be moved upward and downward via the guide 60. On the guide two lugs 61, 62 are arranged at a distance from each other. They project on one side from the guide 60, i.e. on the side facing the bobbin storages 23, 24. One bobbin 13, 14 can be placed with its outer surface on the lugs 61, 62 by the transport cog 51. For this purpose the column 59 ends below the movement range of the transport cog 51 (horizontal position of the transport arm 54). By means of a further axial -dislocation of the transport cog 51 it is removed from the central opening 52 of the bobbin.

Figure 4:
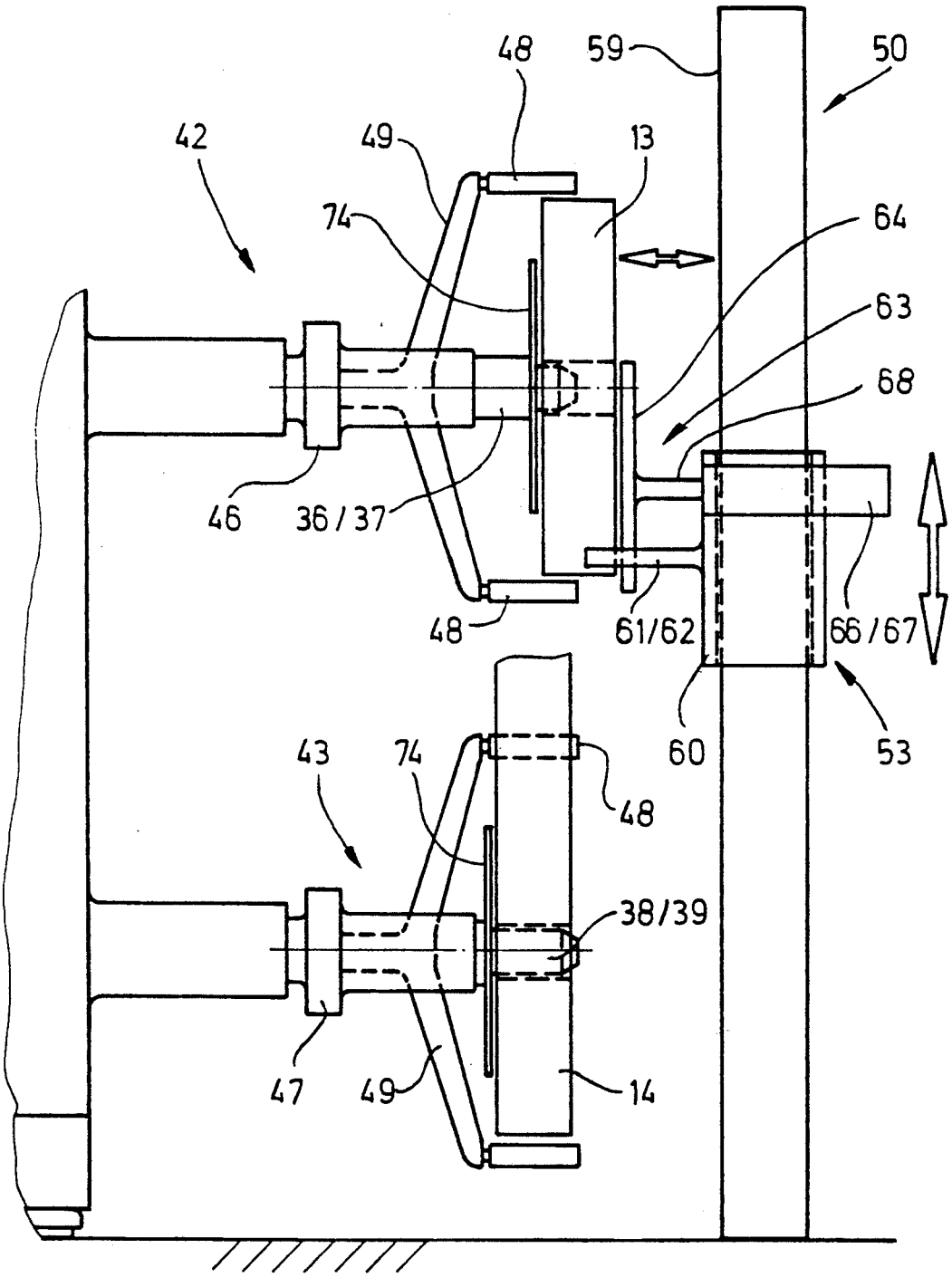
FIG. 4 shows a lower area of the device, i.e. the consumption stations for bobbins, in a view according to FIG. 3 in an enlarged scale.
Figure 5:
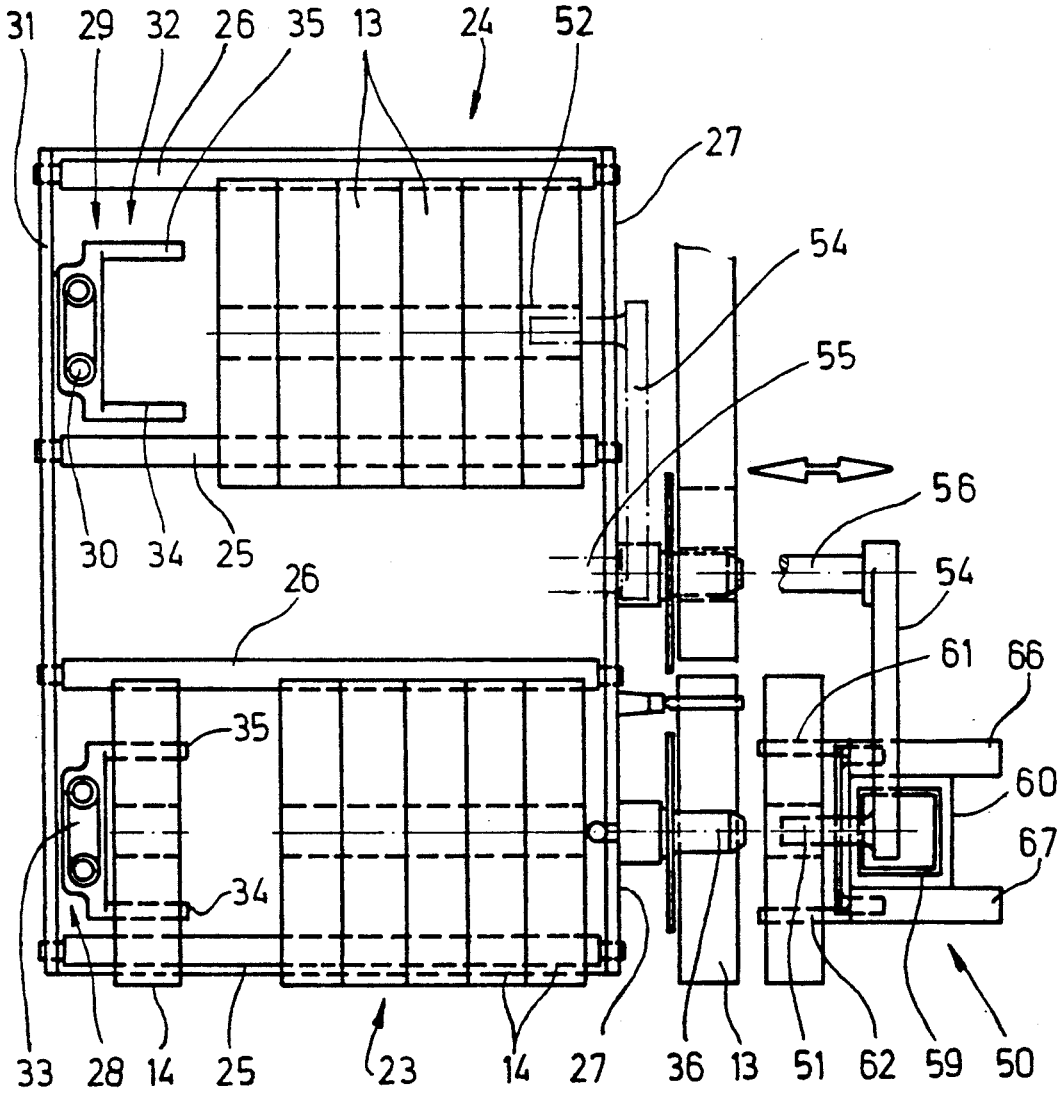
FIG. 5 shows the upper area of the device, the bobbin storage, in horizontal projection.

By means of the carrying means 53 the bobbin placed on the lugs 61, 62 is transported downward, i.e. alternatively to the upper or lower bobbin aggregate 42, 43. The transfer to one of the working cogs 36 . . . 39 takes place by dislocating the corresponding bobbin in an axial direction directly on the waiting working cog 36 . . . 39. The arrangement is such that the working cogs 36 . . . 39 in the receiving position are exactly centrally positioned to the carrying means 53 (left in FIG. 1 and FIG. 2) and hence to the center opening 52 of the bobbin. In the receiving position the working cogs 36 . . . 39 are immediately neigboring to the carrying means 53 and hence to the supplied bobbin 13, 14. A slight axial dislocation is required for the transfer (FIG. 4).

The transfer of a bobbin 13, 14 from a carrying means 53 to a working cog 36 . . . 39 takes place by a stripper organ. In the present embodiment a stripper 63 is fixed to the carrying means 53, i.e. directed towards the position of the bobbin 13, 14. The stripper 63 contains a relatively large-surfaced stripper plate 64 which is driven towards the free side of the bobbin 13, 14. This way it is pushed from the lug 61, 62 onto the waiting working cog 36 . . . 39.

Figure 2:
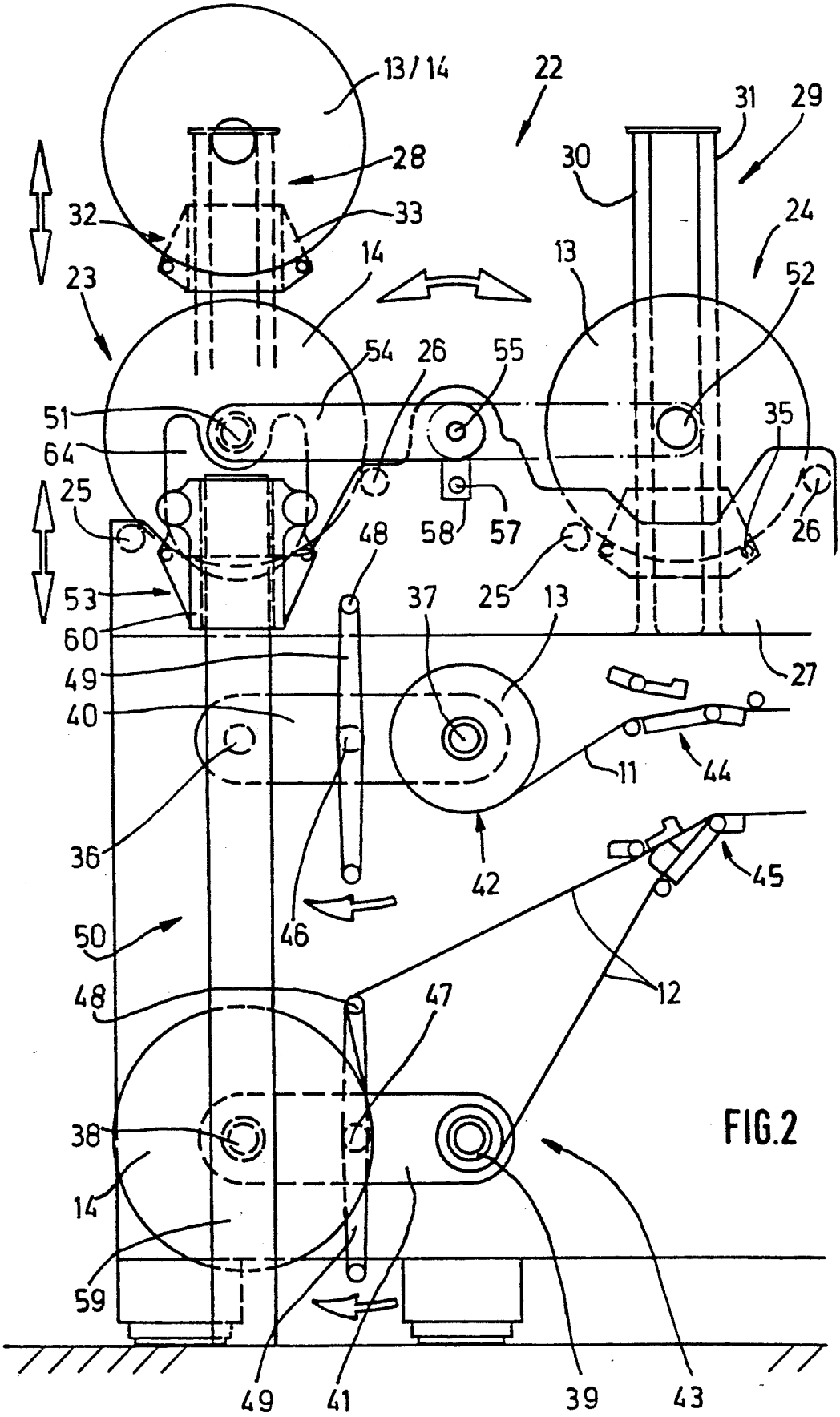
FIG. 2 shows a section of the device according to FIG. 1 in an enlarged scale.

The stripper plate 64 is formed in a special way (in particular FIG. 2). The stripper plate 64 comes primarily in the lower region of the bobbin 13, 14 of it to the device so that jamming or tilting of the same during the stripping is avoided. In the upper region the stripper plate 64 has a recess 65 enabling an extension of the stripper plate 64 until almost above the center level of the bobbin 13, 14. The recess 65 enables the introduction of the supplier cog 51 during the supply of a bobbin.

The stripper 63 is actuated by two cylinders 66, 67 which are arranged at a distance to each other. They are fixed at opposite sides of the guide 60. Each of the two cylinders 66, 67 is connected with the stripper plate 64 via a connecting rod 68.

Figure 6:
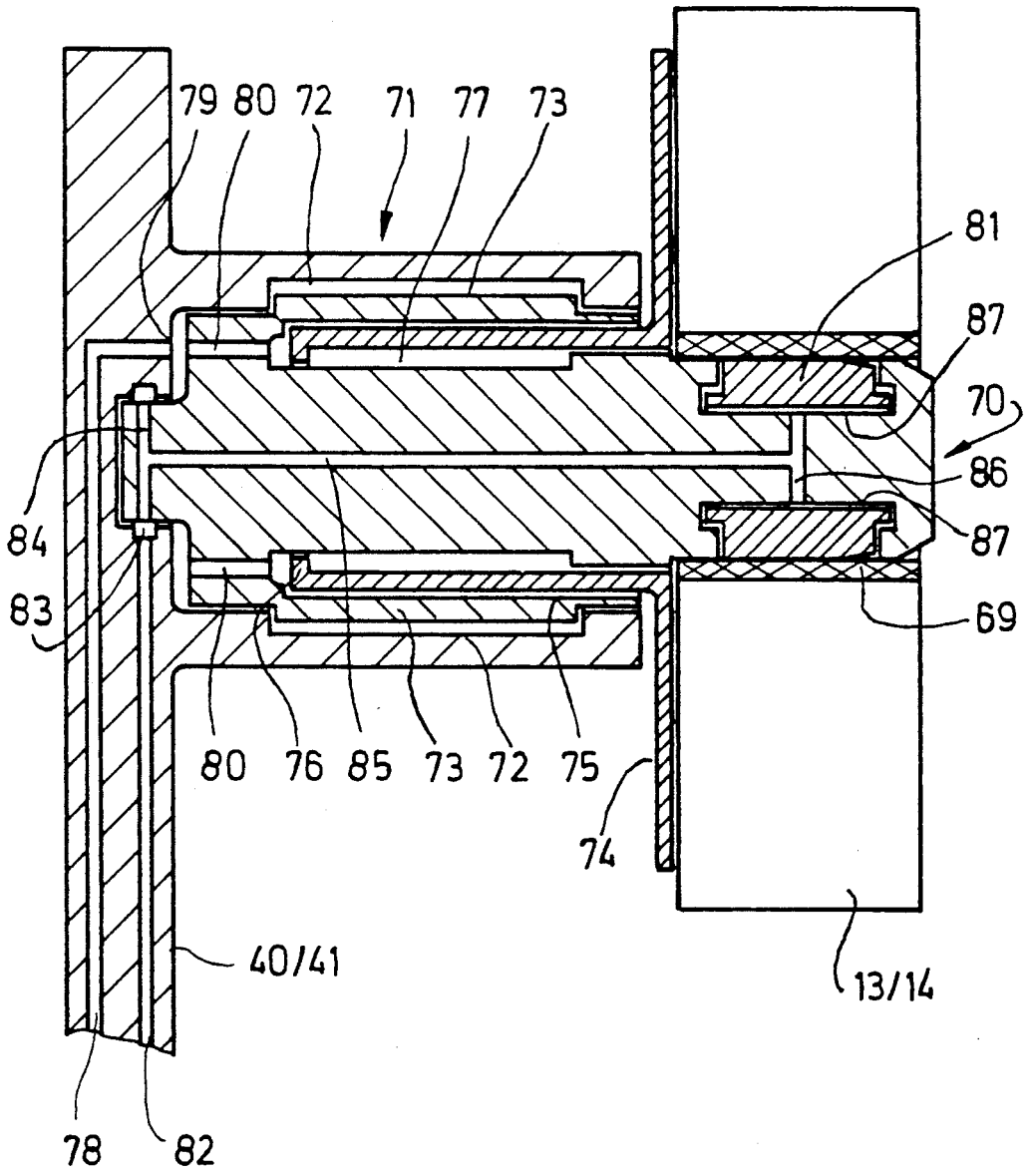
FIG. 6 shows a cog (working cog) for a bobbin in longitudinal section, again in enlarged scale.
Figure 7:
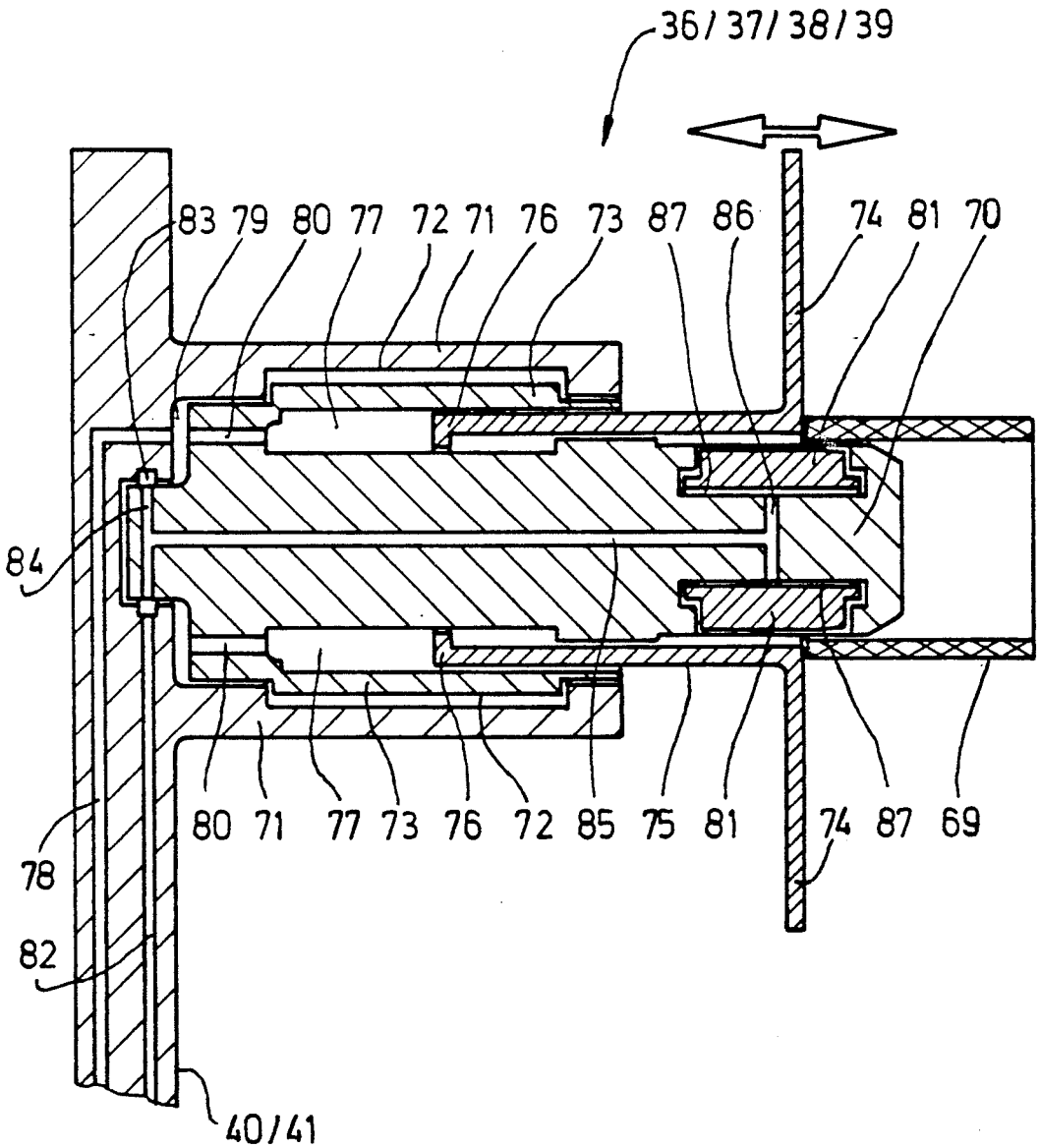
FIG. 7 shows the detail according to FIG. 6 during the automatic stripping movement of a bobbin core.

Before the working cog 36 . . . 39 of a bobbin aggregate 42, 43 can be moved out of the working position (right in FIG. 1 and FIG. 2) into the reception position for a new bobbin, a bobbin rest of the empty bobbin or a bobbin core 69 consisting e.g. of cardboard must be drawn off the working cog 36 . . . 39. FIG. 6 and FIG. 7 show the arrangement of a cog (working cog 36 . . . 39) for a bobbin 13, 14 with a contrivance for a self-acting, automatic stripping of the bobbin core 69.

The bobbin 13, 14 or the bobbin core 69 is located on a central cog 70 of the working cog 36..39. The central cog 70 is rotatable in a stationary axial direction. In the present example (FIG. 6, 7) the central cog 70 is rotatable in a hollow cog 71. The hollow cog 71 again is connected with a machine part or with the swinging arm 40, 41. A turned groove 72 is present in the hollow cog 71 in which the central cog 70 is pivoted and guided with a collar 73.

The rest bobbin or the bobbin core 69 is removed from the central cog 70 by way of an axial displacement of a stripping organ. In the present embodiment the stripping organ is formed by a disc 74. This disc 74, which is correspondingly measured in its diameter, serves at the same time as face for the bobbin 13/14 during the withdrawal of the material. The disc 74 is movable in axial direction on the central cog 70 in order to strip the bobbin core 69, i.e. from the initial position according to FIG. 6 to the free end of the central cog 70. FIG. 7 shows a stripping position.

On the side of the disc 74 opposite to the bobbin core 69 an actuation organ for the axial movement is allocated. It is an actuating cylinder 75 which envolves the central cog 70. The free end of the actuating cylinder 75 has a distortion 76 facing inward, i.e. a broadening cross section. It acts as a ring-formed piston in a cylinder chamber 77 of the central cog 70. The cylinder chamber extends in the area of collar 73 within the cross section of the central cog 70. Advantageously, the cylinder chamber 77 is formed ring-shaped in its cross section, i.e. in the form of a cylinder. On the side facing the disc 74 the actuating cylinder 75 acts as a pushing organ out of the cylinder chamber 77.

The cylinder chamber 77 can be supplied with a pressure medium, in particular compressed air. In the present embodiment a main line 78 leads into a ring-formed collecting chamber 79 in the hollow cog 71. On the side facing the distortion of the cylinder chamber 77 several channels 80, arranged along the circumference, enter from the collecting chamber 79 into the cylinder chamber 77. Via these channels 80 the cylinder chamber 77 is supplied with compressed air in such a way that the actuating cylinder 75 is driven by application of compression on the distortion 76 in axial direction, from the initial position towards the free end of the central cog 70 according to FIG. 6. This way the bobbin core 69 is removed from the central cog 70. In order to return the disc 74 to the initial position the cylinder chamber 77 is deaerated so that a manual displacement or an allocation of a new bobbin 13, 14 can take place automatically.

In the area of the placing of the bobbin 13, 14 or the bobbin core 69 on the central cog 70 clamping organs, i.e. clamping jaws 81 are placed in the central cog 70.

They are moved out in radial direction in order to fix the bobbin 13, 14 or the bobbin core 69 on the free end of the central cog 70 by gripping it.

In the present case the clamping jaws 81 are also actuated by compression, in particular by compressed air. Over a central line 82 in the swinging arm 40, 41 compresssed air is supplied into a ring line 83 at the end of the central cog 70. From the ring line 83 compression lines 84, 85 and 86 lead to the compression chambers 87 in which the clamping jaws 81 are placed. In order to actuate these, compressed air is applied on the compression chambers 87. In this manner the clamping jaws 81 are driven outwards in a radial manner against the inner side of the bobbin core 89. In order to strip the same and to allocate a new bobbin the compression chambers are deaerated enabling the clamping jaws 81 to be displaced inwardly.

We claim:

1. A device for supplying a packaging machine with packaging material in the form of wound webs in bobbins, said device comprising:

two bobbin storages (23, 24) located next to one another, each for receiving a different one of two different types of bobbins (13, 14);

a common vertically extending bobbin supplier (50, associated with both bobbin storages (23, 24), for feeding the bobbins (13, 14) to a packaging machine located below said bobbin storages (23, 24); and an intermediate bobbin supplier for extracting the bobbins (13, 14) from said bobbin storages (23, 24) and for feeding the bobbins to said common bobbin supplier (50);

wherein said intermediate bobbin supplier has a transport arm (54) which is mounted for pivoting movement about a shaft (56) and which is displaceable for axial movement in a direction parallel to the axis of said shaft.

2. The device according to claim 1, comprising a transport cog (51) which is mounted on said transport arm (54) and which is movable centrally in front of the bobbins (13, 14) by means of the pivoting and axial movements of said transport arm (54).

3. A device for supplying a packaging machine with packaging material in the form of wound webs in bobbins, said device comprising:

at least one bobbin storage (23, 24) disposed above the packaging machine;

two bobbin-processing assemblies (42, 43) disposed one above the other, each of said assemblies (42, 43) having two working cogs (36 to 39), a first of said working cogs being located in a receiving position for receiving a bobbin (13 or 14), and the second of said working cogs being in a working position relative to a web of material running off a bobbin; and a vertically extending bobbin supplier (50) disposed for conveying the bobbins (13, 14) from said bobbin storage (23, 24) to said first and second working cogs (36 to 39) of both said assemblies, said bobbin supplier (50) having a vertical transport path which extends from said bobbin storage (23, 24) to a position adjacent said receiving position of said working cogs (36 to 39).

4. A device for supplying a packaging machine with packaging material int he form of wound webs in bobbins, said device comprising:

two bobbin storages (23, 24) disposed vertically above the packaging machine;

a horizontal floor-mounted supplier (15) disposed above said bobbin storages (23, 24); and two vertical bobbin lifts (28, 29), each assigned to a different one of said bobbin storages (23, 24) for transporting the bobbins (13, 14) form said floor-mounted supplier (15) to said bobbin storages (23, 24), wherein each bobbin lift (28, 29) comprises a bobbin receptacle (32), wherein, in said bobbin storages (23, 24), the bobbins (13, 14) are located in a bearing plane, and wherein each bobbin receptacle (32) is lowerable to a region below the bearing plane for a transfer of the bobbins.

5. The device according to claim 4, wherein each of said bobbin storages (23, 24) comprises two spaced apart carrying rods (25, 26) in said bearing plane and on which peripheral surfaces of the bobbins (13, 14) rest, and wherein said bobbin receptacle (32) comprises carrier cogs (34, 35) which are movable past said carrying rods (25, 26) for the transfer of the bobbins.

6. A device for supplying a packaging machine with packaging material in the form of wound webs in bobbins, said device comprising:

two bobbin-processing assemblies (43, 43) associated with the packaging machine and disposed one above the other, each of said assemblies (43, 43) having two working cogs (36 to 39), a first of said working cogs being located in a receiving position for receiving a bobbin (13 or 14), and the second of said working cogs being in a working position relative to a web of material running off a bobbin; and two bobbin storages (23, 24) for receiving different types of bobbins (13, 14) and disposed next to one another above the packaging machine;

a common vertically extending bobbin supplier (50), associated with both bobbin storages (23, 24), for feeding the bobbins (13, 14) to a packaging machine located below said bobbin storages (23, 24); and an intermediate bobbin supplier for extracting the bobbins (13, 14) from said bobbin storages (23, 24) and for feeding the bobbins to said common bobbin supplier (50);

wherein said intermediate bobbin supplier has a transport arm (54) which is mounted for pivoting movement about a shaft (56), which is displaceable for axial movement in a direction parallel to the axis of said shaft, and which has a transport cog (51) for receiving the bobbins;

a vertical bobbin lift (28, 29) assigned to each bobbin storage (23, 24);

a horizontal floor-mounted supplier (15) located above the bobbin storages (23, 24), the bobbins (13, 14) being feedable from said floor-mounted supplier (15) to said bobbin storages (23, 24) by means of the bobbin lifts (28, 29), wherein each bobbin lift (28, 29) has a bobbin receptacle (32), and wherein, in said bobbin storages (23, 24), the bobbins (13, 14) are located in a bearing plane; and means for lowering said bobbin receptacle (32) to a region below said bearing plane for a transfer of the bobbins.

* * * * *